US006263679B1

(12) United States Patent
Paynting

(10) Patent No.: US 6,263,679 B1
(45) Date of Patent: Jul. 24, 2001

(54) PARTICULATE DAM FOR CRYOPUMP FLANGE

(75) Inventor: Richard J. Paynting, Cumberland, RI (US)

(73) Assignee: Helix Technology Corporation, Mansfield, MA (US)

( * ) Notice: Subject to any disclaimer, the term of this patent is extended or adjusted under 35 U.S.C. 154(b) by 0 days.

(21) Appl. No.: 09/542,345

(22) Filed: Apr. 5, 2000

(51) Int. Cl.[7] ..... B01D 8/00
(52) U.S. Cl. ..... 62/55.5; 277/630; 277/650
(58) Field of Search ..... 62/55.5; 277/630, 277/650

(56) References Cited

U.S. PATENT DOCUMENTS

| | | | | |
|---|---|---|---|---|
| 5,043,148 | * | 8/1991 | Yasue | 62/55.5 |
| 5,062,271 | * | 11/1991 | Okurmura et al. | 62/55.5 |
| 5,261,244 | * | 11/1993 | Lessard et al. | 62/55.5 |
| 5,333,466 | | 8/1994 | Harrington et al. | 62/55.5 |
| 5,357,760 | * | 10/1994 | Higham | 62/55.5 |
| 5,483,803 | * | 1/1996 | Matte et al. | 62/55.5 |
| 5,542,257 | | 8/1996 | Mattern-Klossen et al. | 62/55.5 |
| 5,548,964 | * | 8/1996 | Jinbo et al. | 62/55.5 |
| 5,782,096 | | 7/1998 | Bartlett et al. | 62/55.5 |
| 5,836,568 | | 11/1998 | Ishigaki et al. | 251/148 |
| 5,887,438 | * | 3/1999 | Johnson et al. | 62/55.5 |
| 5,901,558 | | 5/1999 | Mattë et al. | 62/55.5 |

FOREIGN PATENT DOCUMENTS

| | | |
|---|---|---|
| 0640 784 A1 | 7/1994 | (EP) . |
| 0 609 232 B1 | 1/1997 | (EP) . |
| 10054355 | 2/1998 | (JP) . |

* cited by examiner

*Primary Examiner*—Ronald Capossela
(74) *Attorney, Agent, or Firm*—Hamilton, Brook, Smith & Reynolds, PC

(57) ABSTRACT

A gasket designed for use with a cryogenic vacuum pump, or cryopump, includes a ring and a dam extending inwardly from the ring. The dam acts as a barrier preventing transport of particulates to a gate valve when the gasket is mounted between the cryopump and gate valve. In an alternative embodiment, the dam is separate from the ring.

23 Claims, 6 Drawing Sheets

PARTICULATE DAM FOR CRYOPUMP FLANGE

BACKGROUND OF THE INVENTION

This invention relates generally to the field of cryogenic vacuum pumps, commonly referred to as "cryopumps." Cryopumps utilize pumping surfaces cooled to cryogenic temperatures by a cryogenic refrigerator to condense and absorb gases.

A known vertical-mount cryopump design is illustrated in FIG. 1. The cryopump 10 is joined at a flange 14 to a process chamber, such as a process chamber of a cluster tool for semiconductor wafer fabrication. The cryopump 10 is then used to remove gases from the process chamber. As is typical, the illustrated cryopump 10 features a pair of pumping surfaces (use of the singular term, "pumping surfaces," hereafter, is to be understood to include both a single surface and any number of additional surfaces). In the illustrated embodiment, the primary, lower-temperature pumping surface is in the form of an array of baffles 34. The array of baffles 34 is cooled to a temperature of about 4K to about 25K by the second stage 32 of a two-stage cryogenic refrigerator. The higher-temperature pumping surface includes a radiation shield 36 and a frontal array 38 in thermal contact with the radiation shield 36. The radiation shield 36 and frontal array 38 surround the lower-temperature array of baffles 34 and are cooled by the first stage 29 of the cryogenic refrigerator. Both pumping surfaces are contained within a vacuum vessel 12.

When the cryopump 10 is operating, gases with higher boiling points (e.g., water vapor) are condensed on the higher-temperature pumping surface. Gases with lower boiling points (e.g., nitrogen) pass through the frontal array 38 of the higher-temperature pumping surface to the lower-temperature pumping surface where they are condensed. Further, an adsorbent, such as charcoal or a molecular sieve, is typically attached to the lower-temperature surface (e.g., to the underside of the baffles 34) to remove gases with very low boiling points, such as hydrogen, helium and neon. The above-described condensation and adsorption produce a high vacuum in the vacuum vellel 11 and in the process chamber to which the cryopump 10 is mounted.

Once a high vacuum is established, a workpiece (e.g., a semiconductor wafer) can be moved into and out of the process chamber through partially-evacuated load locks. Each time the process chamber is opened, additional gases enter there through. These gases are then condensed onto the pumping surfaces, thereby maintaining the low-pressure conditions needed for processing the workpiece. In addition, processing gases that are introduced in the process chamber are also condensed onto the pumping surfaces.

After several days or weeks of continued processing, the gases that condense and absorb on the pumping surfaces begin to saturate the cryopump 10. The trapped gases are then released from the pumping surfaces via a regeneration procedure, whereby the cryopump 10 is temporarily shut down to allow the pumping surfaces to warm. As the surfaces warm, so do the gases condensed thereon, thereby facilitating the release of these gases. The released gases are then purged from the vacuum vessel, and cooldown of the cryopump 10 is repeated.

DISCLOSURE OF THE INVENTION

Over the course of cryopump operation and, in particular, during regeneration, particulates of the adsorbent (e.g., charcoal) may detach from the baffles and circulate within the radiation shield. In existing systems, when captured species are released during regeneration, they may pass through a liquid phase, and before the species becomes gaseous, the liquid can wash the adsorbent particulates from the cryopump to the gate valve of a process chamber. Adsorbent particles can also be deposited via vapor transport at the gate valve during a purge of the cryopump. Adsorbent particles that reach the gate valve can be trapped in the seal of the gate valve and ground up with subsequent opening, and closing of the gate valve. Trapping of adsorbent particles in the seal of the gate valve also interferes with the ability to form a gas-tight barrier when the gate valve is closed. In accordance with this invention, the transport of particulates to the gate valve is prevented by using a dam for trapping particulates at or within the flange of the gate valve.

A dam of this invention is sized and shaped to stop the flow of particulates from the cryopump to the seal and valve member of the gate valve. The dam can be part of a gasket mounted at the junction of the flange of a cryopump and the flange of a gate valve. Alternatively, the dam can be a separate component from the gasket.

A gasket of this invention includes a ring, and a dam extending from the ring into an interior volume defined by the ring The gasket is sized and shaped to be mounted at the junction of the flanges of a cryopump and a gate valve. The gasket is particularly well suited for use with cryopumps that are horizontally mounted to a gate valve at a port of a process chamber, in which case the dam is positioned toward the bottom of the flange.

Though the ring and dam are separately recited for clarity of description, the two can jointly form a seamless, unlitaly assembly. Where the gasket ring and the dam are separate elements, both can mounted at the interface of the flanges of the cryopump and a gate valve on a process chamber, or the dam can be separately mounted via a secured spring within a corridor of the gate valve extending from the flange, in which case, the dam is still considered to be mounted "at the flange." In either case, the ring is preferably circular in shape, though a ring of this invention need not be precisely circular.

The dam can have the shape of a disc section and can inwardly extend from the arch-shaped edge between about 5% to about 15% of the diameter of the passage between the crypump and gate valve. In further preferred embodiments, the dam has a height of at least about 1 cm, more preferably between about 0.5 inches (about 1.3 cm) and about 1 inch (2.5 cm). Further, the gasket can be formed of copper, with the ring having an inner diameter of about 20 cm.

In a method of this invention, a cyropump can be mounted to the gate valve by positioning the dam, either as part of the gasket or separate therefrom, between a flange on the cryopump and a flange on the gate valve and compressing the gasket between the flanges. Preferably, the gasket is in a substantially-vertical plane with the dam positioned at the bottom of the gasket. When the cryopump is put into operation, wherein the cryopump is cooled to generate a vacuum in the process chamber with intermittent regeneration procedures and coordinate opening and closing of the gate valve, the gasket prevents loose particulates in the cryopump from reaching the gate valve. In alternative embodiments of the method, the dam can be positioned within the flange (i.e., within the corridor defined by an inner surface of the flange and the tubing that extends therefrom to the valve member).

An advantage of this invention is that the dam can be used to reduce or prevent transport of adsorbent particulates to the gate valve. As a consequence, the cleanliness of the process chamber, which is of extreme importance in fields such as semiconductor wafer processing, can be better insured. Further, the gasket and dam of this invention will reduce or eliminate problems associated with an inability to fully seal the gate valve due to contamination of the seal by adsorbent particulates. Further still, the dam of this invention is not only effective as a barrier against transport of adsorbent particulates, but also as a barrier against the transport of any other debris originating from or entering into the cryopump.

BRIEF DESCRIPTION OF THE DRAWINGS

The foregoing and other objects, features and advantages of the invention will be apparent from the following, more-particular description of preferred embodiments of the invention, as illustrated in the accompanying drawings in which like reference characters refer to the same parts throughout the different views. The drawings are not necessarily to scale, emphasis instead being placed upon illustrating the principles of the invention. For example, the thickness of the gasket shown in FIGS. 4–6, is thicker than actual scale to better illustrate the principles of this invention.

DETAILED DESCRIPTION OF PREFERRED EMBODIMENTS

A dam of this invention is sized and shaped to be mounted at the flange of a gate valve to substantially reduce the transport of particles from a cryopump to a valve member in the gate valve.

Figure 1:
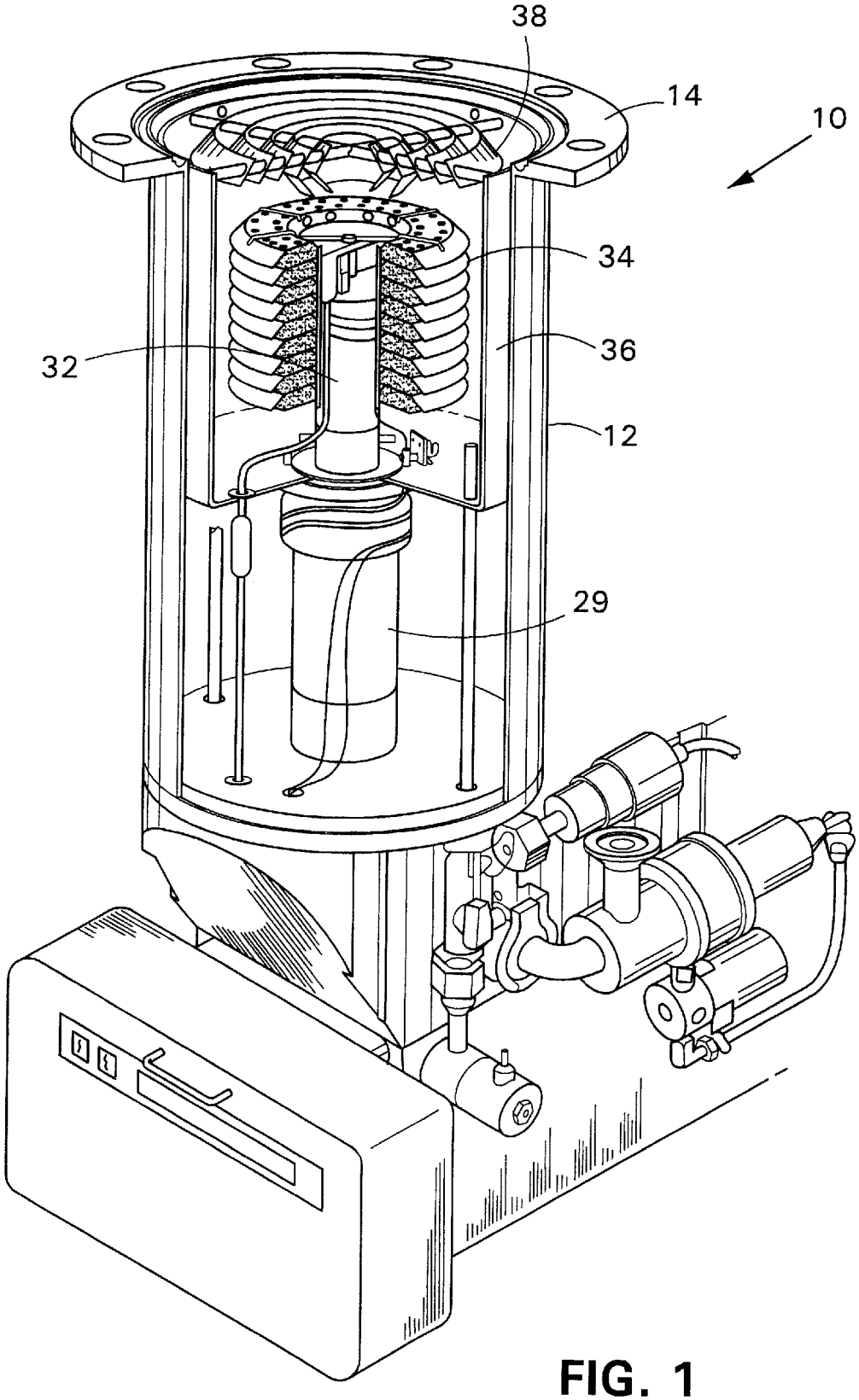
FIG. 1 PRIOR ART
FIG. 1 is an illustration of a cryopump of the prior art.

An embodiment of a gasket of this invention is illustrated in FIG. 1. The gasket includes a ring and a dam. In the illustrated embodiment, the ring and dam form an essentially-flat, integral, and unitary structure.

Figure 3:
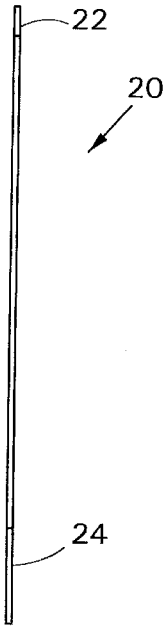
FIG. 3 is an illustration of a sectional side view of the gasket shown in FIG. 2.
Figure 2:
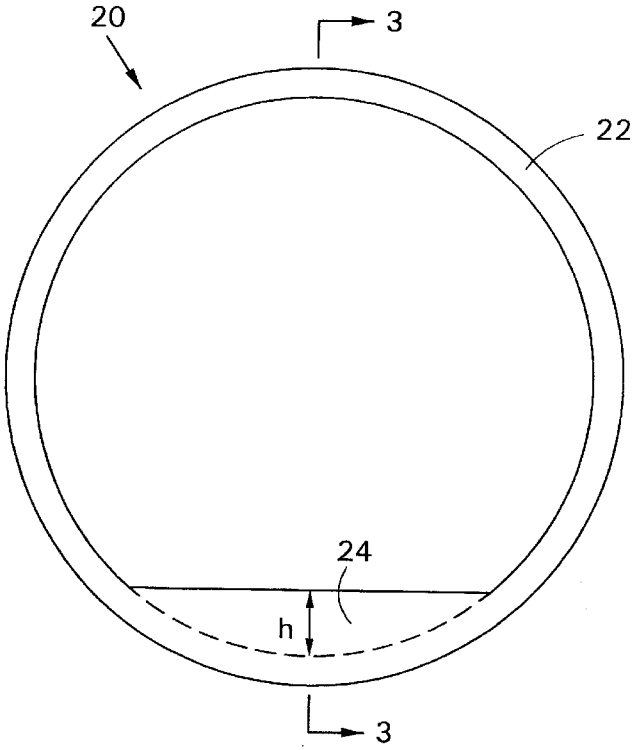
FIG. 2 illustrates an embodiment of a gasket of this invention.

The gasket, illustrated in FIGS. 2 and 3, is formed of a material able to withstand chemical exposure and the cryogenic vacuum environment in the cryopump and process chamber and also sufficiently malleable to conform to the knife edges of a flange to form an impermeable seal. Preferably, the gasket is formed of a relatively soft metal, such as copper. The gasket can be fabricated by stamping it from a sheet of metal or by soldering the dam to an existing ring-shaped gasket. The diameter of the ring approximately matches that of respective flanges on a cryopump and a port on a process chamber to which the cryopump is joined such that the ring will form a seal when the two flanges are joined. The outer diameter will typically be about 8.7 inches (about 22 cm). The inner diameter of a preferred ring is about 8.0 inches (about 20 cm), and the thickness of the ring is preferably about 0.08 inches (about 0.2 cm). The dam is sized and shaped to block the passage of adsorbent particulates through the gasket during standard operation of the cyropump. The gasket is typically employed in a substantially-vertical orientation, wherein the dam is positioned at the bottom of the (gasket to effectively block the passage of adsorbent particulates transported along the floor of the passage.

The height, h, of the dam (i.e., the radial distance from the inner edge of the ring, which may be in the form of an imaginary boundary, to the far edge of the dam at its most remote point) preferably is at least about 1 cm and, more preferably, about 0.5 inch to about 1.0 inch (about 1.3 cm to about 2.5 cm). The optimal height of the dam for a particular application depends on the type of adsorbent used. Typically, the adsorbent is charcoal; nevertheless, particle size and other properties of the charcoal that influence its mobility may vary. The height of the dam may be increased beyond this range as needed. However, increasing the height of the dam will generally decrease the pumping speed of the cryopump, so greatest advantage is likely to be achieved with a dam height sufficient to prevent movement of particulates out of the cryopump but no higher.

Figure 4:
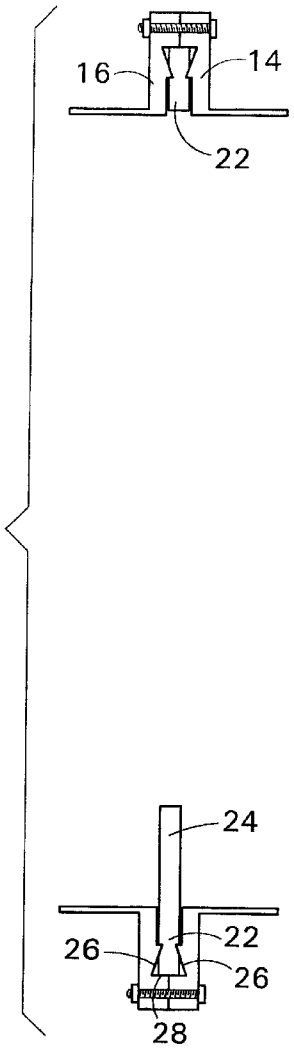
FIG. 4 is a sectional side view of an embodiment of a cryogenic vacuum pumping apparatus of this invention.

A cross-section of a gasket of this invention mounted between a CONFLAT sealing flange 14 (available from Varian Associates, Palo Alto, Calif., USA) on a cryopump and a CONFLAT flange 16 on a gate valve is illustrated in FIG. 4. As shown, each sealing flange 14/16 includes a pair of knife edges 26 that "bite" into the gasket 20 and cause gasket material to flow outward until it butts up against the flange supporting surfaces 28. A gas-tight seal is thereby formed at the juncture of the cryopump and port of the process chamber.

Figure 5:
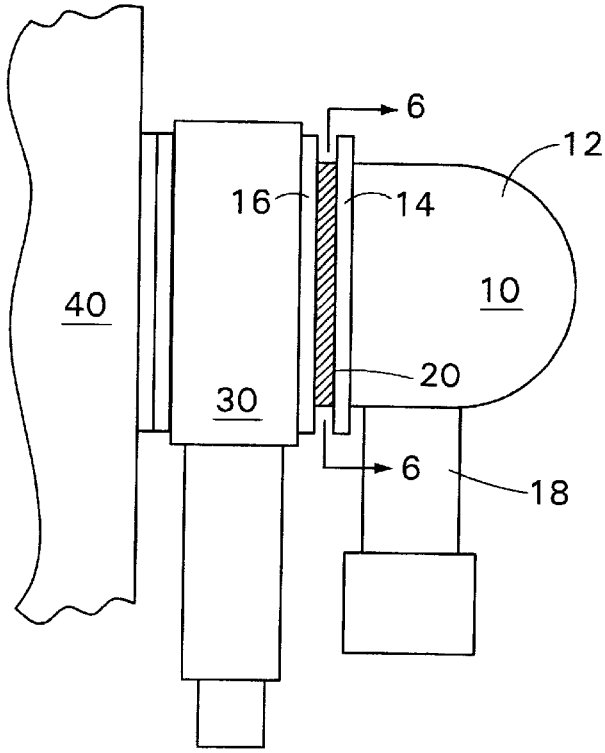
FIG. 5 is an illustration of the gasket of FIGS. 2 and 3 mounted on the cyropump.
Figure 6:
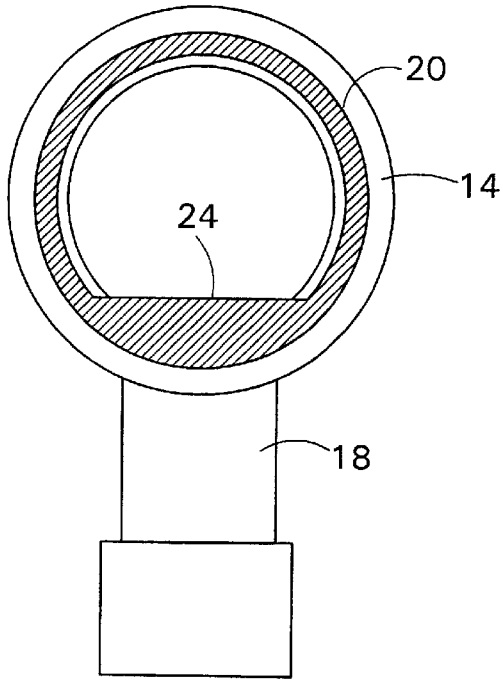
FIG. 6 is a sectional view of the cryogenic vacuum pumping apparatus of FIG. 4 showing the gasket mounted between a gate valve and a cryopump.

In the embodiment illustrated in FIG. 5, a cryopump 10 is horizontally mounted to the port of a process chamber 40 through a gate valve 30. The baffle array and radiation shield of the cryopump 10 are housed within vacuum vessel 12. The first stage of the refrigerator is contained in shell 18, and the second stage extends into the vacuum vessel 12 where the refrigerator is coupled with the pumping surfaces. A cross-sectional view of the gasket 20 on the flange 14 of the cryopump is provided in FIG. 6. Unlike the coaxial vertical-mount cryopump of FIG. 1, the refrigerator of the horizontal-mount, or "flat," cryopump 10 of FIGS. 5 and 6 is coupled with the pumping surfaces at a 90° angle. Flat cryopumps are more compact than vertical-mount cryopumps and are further described in U.S. Pat. No. 5,782,096, which is incorporated herein by reference in its entirety.

Figure 7:
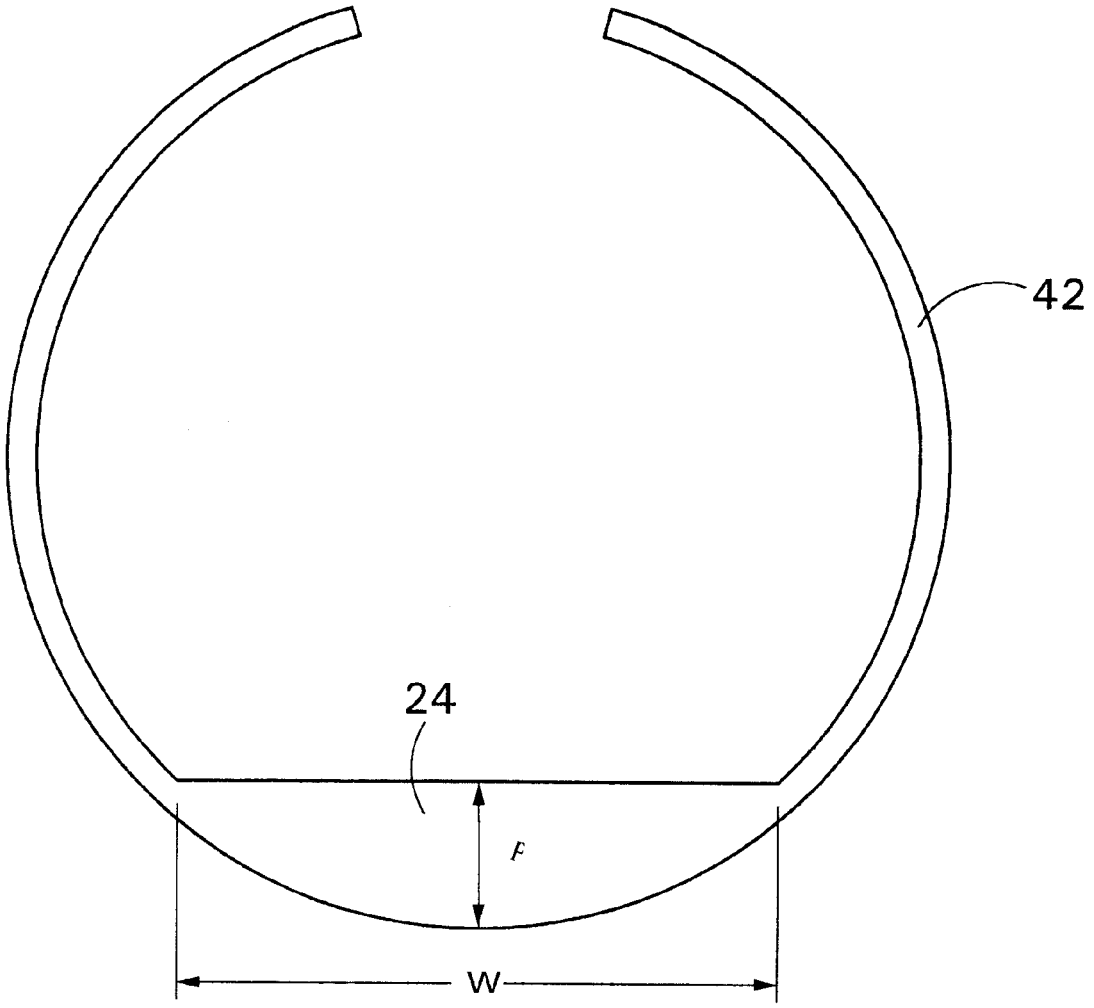
FIG. 7 is a view of an embodiment of a dam of this invention including a spring ring, wherein the dam is not part of the gasket.
Figure 8:
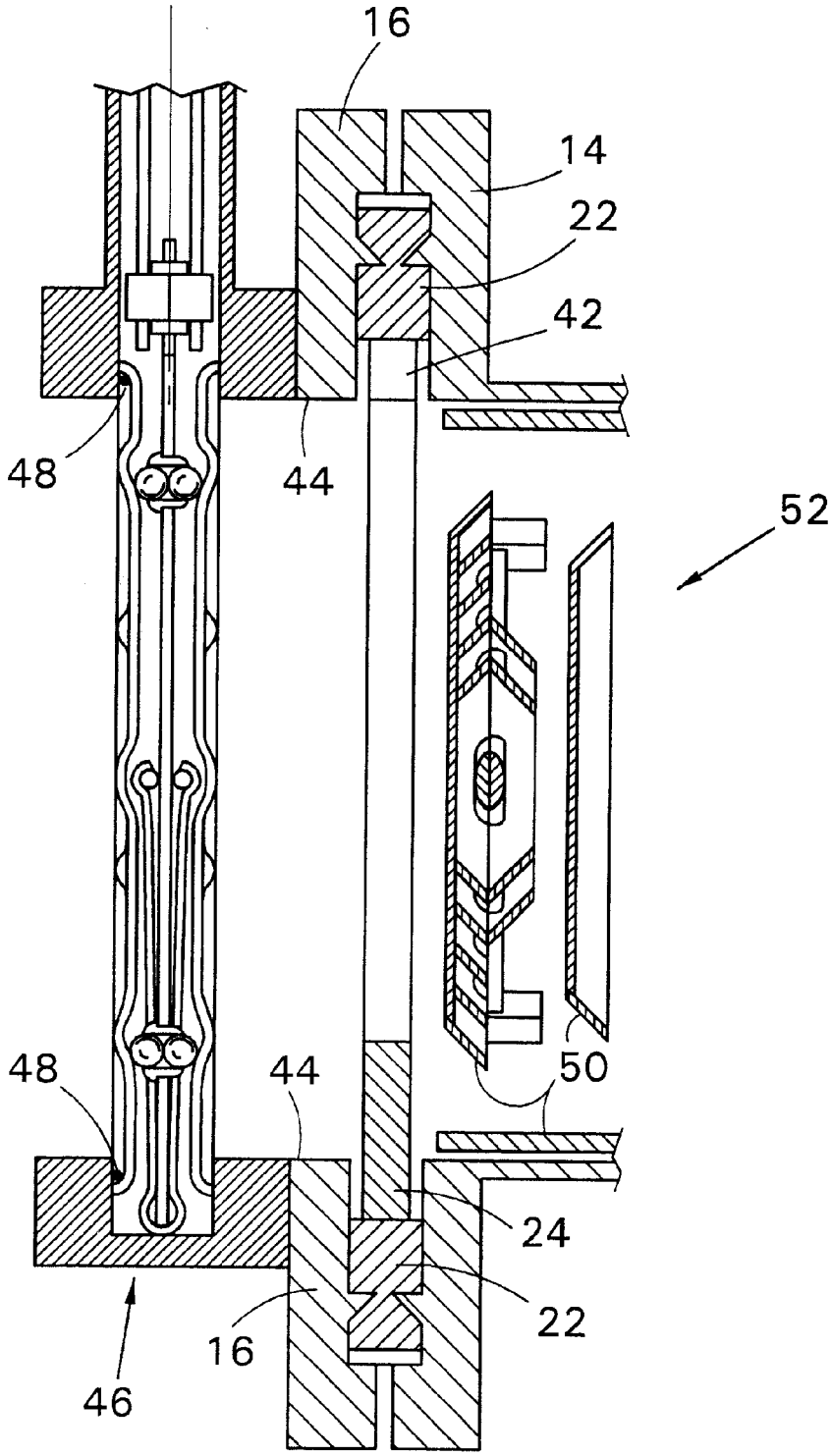
FIG. 8 is a sectional view of the dam of FIG. 7 mounted at the junction of the flanges of the cryopump and gate valve.

In alternative embodiments, the dam is separate from the gasket. As shown in FIG. 7, the dam 24 can include a spring loop 42 for mounting the dam 24 against an inner surface of the corridor between the cryopump and the valve member of the gate valve. Preferably, the dam 24 has the shape of a disk section (i.e., having an edge in the form of a section of a circular arch with a second edge preferably being linear), wherein the height, h, of the disk section is about 1–3 cm, and the width, w, of the disk section is about 10–15 cm. The cross-section of the spring loop 42 can be circular, as in a wire form, or it can have a rectangular, square, or other shape. The spring loop 42 can have nearly the same diameter as the ring 22 allowing the dam 14 to be snapped into place and rotated to adjust the position of the dam at the junction of the flanges 14, 16, as shown in FIG. 8. Alternatively, the dam 24 can be mounted within the flange 16 of the gate valve, wherein the dam is positioned with the spring loop 42 loaded against a corridor 44 formed by the inner surface of the flange 16 and a tubular section extending therefrom. In either case, the dam is considered to be mounted "at the flange" of the gate valve. FIG. 8 also illustrates the gate valve 46, including seals 48, and several of the pumping surfaces 50 in the cryopump 52.

Figure 9:
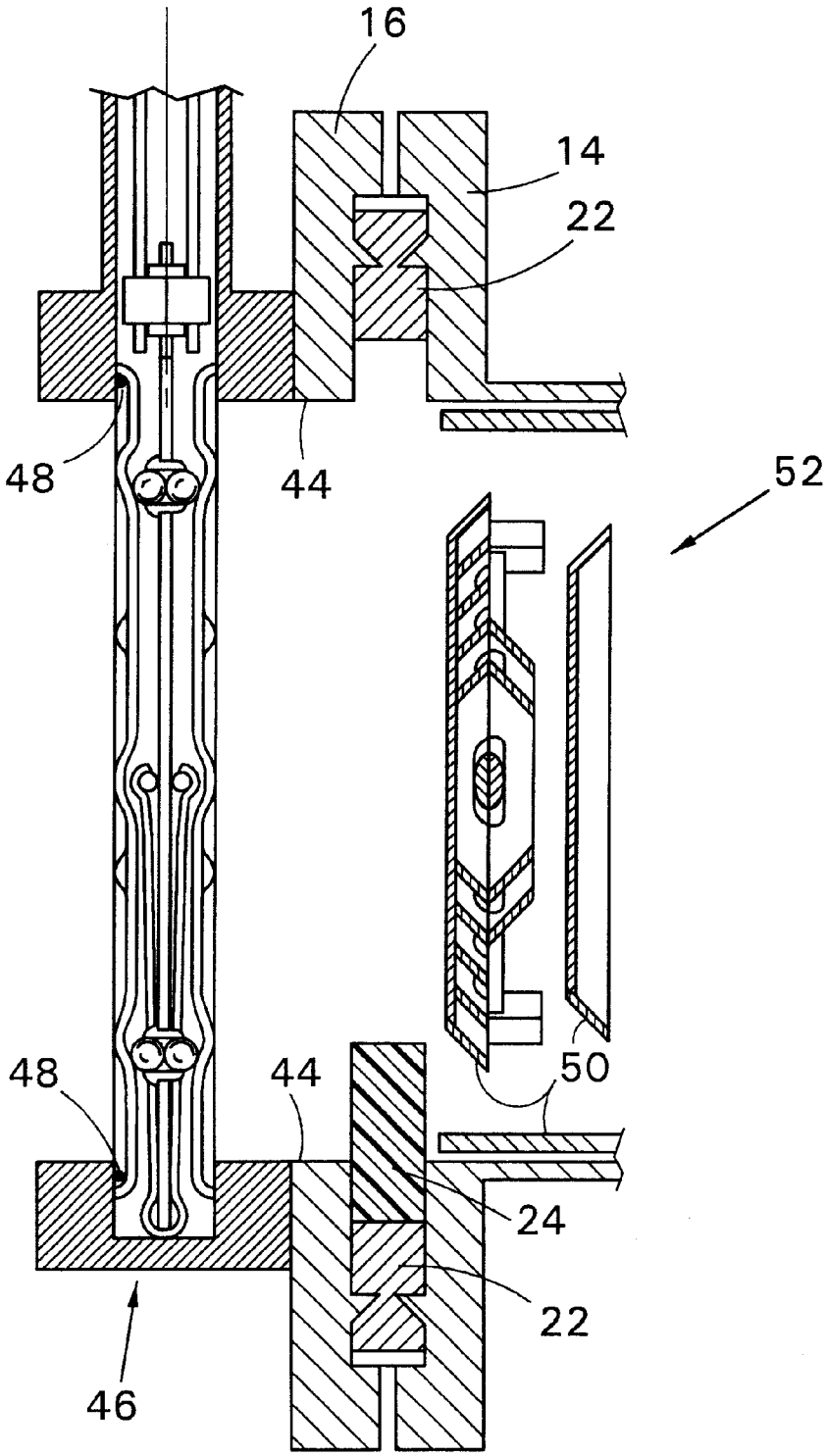
FIG. 9 is a sectional view of another embodiment of a dam of this invention clamped between the flanges of the cryopump and gate valve.

FIG. 9 illustrates an alternative embodiment of a dam 24 separate from the gasket ring 22, wherein the dam 24 is clamped in the groove between flanges 14, 16 inside the gasket ring 22. In this embodiment, the dam 24 is preferably formed of a material (e.g., TEFLON fluoropolymer) that is more compliant than the gasket ring 22 (which is typically formed of copper) so as not to interfere with the crushing of the gasket 22 and the quality of the resultant seal.

In a method of this invention utilizing the apparatus of FIG. 5, the cryopump 10 operates to cool a pumping, surface upon which gases are condensed. When a near-vacuum is established in the vacuum vessel 12 of the cryopump 1O, a gate valve 30 between the cryopump 10 and process chamber 40 is opened, thereby allowing gases in the process chamber 40 to flow out of the process chamber 40 and into the cryopump 10, where the gases arc condensed or adsorbed. As time passes, condensates build up on the pumping surfaces necessitating that the pumping surfaces be "regenerated." When regeneration is performed, the pumping surfaces are warmed to a temperature sufficient to release the gases that are condensed and adsorbed thereon. During this process, in particular, adsorbent particulates can be shed from the pumping, surfaces. The dam 24, however, forms a physical barrier that prevents released adsorbent particulates from reaching the gate valve 30, consequently preventing the problems associated therewith.

While this invention has been particularly shown and described with references to preferred embodiments thereof, it will be understood by those skilled in the art that various changes in form and details may be made therein without departing from the scope of the invention encompassed by the appended claims.

What is claimed is:

1. Apparatus for cryogenic vacuum pumping, comprising:

(a) a gate valve designed to control vapor flow between a cryopump and a process chamber, the gate valve having:

(1) a valve member, and (2) a flange suitable for mounting a cryopump; and (b) a dam sized and shaped to be mounted at the flange of the gate valve and adapted to prevent the transport of particulates from the cryopump to the valve member.

2. The apparatus of claim 1, further comprising a gasket sized and shaped to be mounted at the flange of the valve member.

3. The apparatus of claim 2, wherein the dam is a part of the gasket, the gasket including a ring and the dam extending inward from the ring.

4. The apparatus of claim 3, further comprising a cryopump, the cryopump including:

a cryogenic refrigerator;

a pumping surface in thermal contact with the cryogenic refrigerator;

a vacuum vessel containing the pumping surface, the vacuum vessel having an open end;

adsorbent within the vacuum vessel; and a flange at the open end of the vacuum vessel.

5. The apparatus of claim 4, wherein the cryopump is horizontally mounted to the gate valve with the gasket mounted between the flange at the open end of the vacuum vessel and the flange of the gate valve.

6. The apparatus of claim 5, wherein the gasket is oriented within a substantially vertical plane such that the gasket has a top and a bottom, with the dam positioned at the bottom of the gasket.

7. The apparatus of claim 6, wherein the dam has a height of at least about 1 cm.

8. The apparatus of claim 6, wherein the dam has a height between about 1.3 cm and about 2.5 cm.

9. The apparatus of claim 6, wherein the adsorbent is charcoal.

10. The apparatus of claim 2, wherein the dam is separate from the gasket.

11. The apparatus of claim 10, wherein the dam includes a disk section and a spring secured to the disk section for mounting the dam within a cylinder.

12. The apparatus of claim 11, wherein the disk section is a section of a disk of about 20 cm diameter.

13. The apparatus of claim 12, wherein the height of the disk is between about 1 cm and about 3 cm.

14. The apparatus of claim 13, further comprising a cryopump, the cryopump including:

a cryogenic refrigerator;

a pumping surface in thermal contact with the cryogenic refrigerator;

a vacuum vessel containing the pumping surface, the vacuum vessel having an open end;

adsorbent within the vacuum vessel; and a flange at the open end of the vacuum vessel.

15. The apparatus of claim 14, further comprising a corridor for gas flow through the flanges, wherein the dam extends across about 5% to about 15% of the distance across the corridor.

16. The apparatus of claim 15, wherein a groove is formed between the two flanges, and wherein the dam is mounted in the groove.

17. A method for mounting a cryopump to a gate valve on a process chamber comprising:

providing a dam that is sized and shaped to block particulate transport in or into the gate valve;

positioning the dam at a flange of the gate valve to block particulate transport from the cryopump to a valve member of the gate valve; and mounting the cryopump to the flange of the gate valve.

18. The method of claim 17, wherein the dam is a component of a gasket, the gasket including a ring defining an interior volume, and the dam extending from the ring into the interior volume, the method further comprising the step of compressing the gasket between the flange of the gate valve and a flange of the cryopump to form a sealed corridor for vapor flow between the cryopump and the gate valve.

19. The method of claim 18, wherein the dam extends a distance between about 1 cm and about 3 cm from the ring.

20. The method of claim 18, further comprising the stop of vertically orienting the gasket such that the dam is at the bottom of the gasket when the gasket is compressed between the flanges.

21. The method of claim 17, further comprising:

providing, a gasket that is discrete from the dam;

positioning the gasket between the flange of the gate valve and a flange of the cryopump; and compressing the gasket between the flanges to form a sealed corridor for vapor flow between the cryopump and the gate valve.

22. The method of claim 21, wherein the dam extends a distance between about 1 cm and about 3 cm across the corridor.

23. The method of claim 21, wherein the axis of the corridor is substantially horizontal and the dam is positioned at the bottom of the corridor.

* * * * *